US008169282B2

(12) United States Patent
Kiyono et al.

(10) Patent No.: US 8,169,282 B2
(45) Date of Patent: May 1, 2012

(54) SWITCH AND ELECTRONIC DEVICE

(75) Inventors: Yasuhiro Kiyono, Nagaokakyo (JP); Toshihiro Naruo, Kyoto (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 13/191,658

(22) Filed: Jul. 27, 2011

(65) Prior Publication Data

US 2012/0025933 A1 Feb. 2, 2012

(30) Foreign Application Priority Data

Jul. 28, 2010 (JP) ..... 2010-168848

(51) Int. Cl.
*H01H 9/00* (2006.01)

(52) U.S. Cl. ..... 335/179; 335/128; 335/170; 335/171; 335/234; 200/553; 200/558; 200/559

(58) Field of Classification Search ..... 335/122, 335/125, 128, 170, 171, 179, 180, 181, 200, 335/229–234; 200/553, 558, 559
See application file for complete search history.

(56) References Cited

U.S. PATENT DOCUMENTS 3,675,166 A * 7/1972 McCloskey et al. ..... 335/164
7,726,297 B2 * 6/2010 Feisthammel et al. .... 126/299 D

FOREIGN PATENT DOCUMENTS

EP 0537700 A1 4/1993
GB 1386904 A 3/1975
JP 11-312451 A 11/1999
JP 3907759 B2 4/2007

OTHER PUBLICATIONS

Extended European Search Report for Application No. 11174695.4, mailed on Nov. 23, 2011 (7 pages).
English Abstract for European Publication No. 0537700, publication date Apr. 21, 1993 (1 page).

* cited by examiner

*Primary Examiner* — Ramon Barrera
(74) *Attorney, Agent, or Firm* — Osha • Liang LLP

(57) ABSTRACT

A switch and an electronic device maintain a power supply ON state until data processing is completed, and automatically turn OFF the power supply after the data processing is completed. The switch includes a rotation operating body that does not receive an operation force from an operating element when OFF operated is arranged inside the operating element. The rotation operating body includes a switch operating portion for turning ON a power supply switch mechanism and a return spring regulating piece for biasing a return spring in an anti-biasing direction. A regulating state of the return spring regulated by the return spring regulating piece is held, where the ON state of the power supply switch mechanism is held with a permanent magnet, and the ON state of the power supply switch mechanism is released by applying a release force on the permanent magnet when the power supply is reset.

12 Claims, 15 Drawing Sheets

100··· SWITCH
120··· OPERATING ELEMENT

100··· SWITCH
120··· OPERATING ELEMENT
130··· ROTATION OPERATING BODY
160··· RETURN SPRING
171··· SOLENOID
180··· POWER SUPPLY SWITCH MECHANISM

100··· SWITCH
120··· OPERATING ELEMENT
160··· RETURN SPRING
171··· SOLENOID

OFF
ON
ONLY OPERATING ELEMENT IS TURNED OFF
100··· SWITCH
120··· OPERATING ELEMENT
130··· ROTATION OPERATING BODY
132··· SWITCH OPERATING PORTION
134··· RETURN SPRING REGULATING PIECE
160··· RETURN SPRING
171··· SOLENOID
172··· MOVABLE MAGNETIC PIECE
180··· POWER SUPPLY SWITCH MECHANISM

200··· SWITCH
220··· OPERATING ELEMENT

220••• OPERATING ELEMENT
230••• SLIDER
233••• SWITCH OPERATING PORTION
234
••• RETURN SPRING REGULATING SHAFT
260••• RETURN SPRING
272••• MOVABLE MAGNETIC PIECE
280••• POWER SUPPLY SWITCH MECHANISM

220··· OPERATING ELEMENT
260··· RETURN SPRING

220••• OPERATING ELEMENT
230••• SLIDER
234
••• RETURN SPRING REGULATING SHAFT
272••• MOVABLE MAGNETIC PIECE
273••• PERMANENT MAGNET
280••• POWER SUPPLY SWITCH MECHANISM 200
210
218
218a
218b
220
223
224
230
233
234
251
252
253
260
271
272
280
281
283
286
287
OFF
ON
ONLY OPERATING ELEMENT IS TURNED OFF
200••• SWITCH
220••• OPERATING ELEMENT
230••• SLIDER
233••• SWITCH OPERATING PORTION
234••• RETURN SPRING REGULATING PIECE
260••• RETURN SPRING
271••• SOLENOID
272••• MOVABLE MAGNETIC PIECE
280••• POWER SUPPLY SWITCH MECHANISM

SWITCH AND ELECTRONIC DEVICE

CROSS-REFERENCE TO RELATED APPLICATIONS

The present application claims priority from Japanese Patent Application No. 2010-168848, filed Jul. 28, 2010. The contents of both priority applications are hereby incorporated by reference in their entirety.

BACKGROUND OF THE INVENTION

1. Technical Field

One or more embodiments of the present invention relate to a switch having a reset function of reliably storing processing data in a hard disk and turning OFF a power supply after data processing is completed when the use of a electronic device including a control unit such as a copy machine or a personal computer is stopped, and an electronic device.

2. Related Art

Generally, in a switch having data protecting performance, contacts included so as to be in contact with or separate from each other in the switch are brought into contact to turn ON the power supply of the switch when the user manually operates an operating element operated in a see-saw manner. The operating element is thereafter automatically inverted by a reset signal outputted by a control unit to switch to a power supply OFF state. Such a switch with reset function has been proposed (e.g., refer to Japanese Patent No. 3907759).

This type of switch with a reset mechanism has contacts that immediately turn OFF the power supply when the user manually OFF operates the operating element to separate the contacts of the switch and turn OFF the power supply. Thus, if the user OFF operates the operating element while data is being written to the hard disk, the power supply is turned OFF without protecting the data to be stored, and hence abnormality occurs such as the data cannot be written or the hard disk main body may break.

SUMMARY OF INVENTION

One or more embodiments of the present invention may provide a highly reliable switch for maintaining a power supply ON state until the data processing in a device is completed even if an operating element is ON operated to operate the device to be used and then the operating element is manually OFF operated with the stopping of the operation, and automatically turning OFF the power supply after the data processing is completed, and an electronic device.

In accordance with one aspect of one or more embodiments of the present invention, there is provided a switch including an operating element supported by a housing and operated to one side and the other side, a return spring for biasing the operating element in a direction operated to the other side in which the operating element is OFF operated, and a power supply switch mechanism for turning ON/OFF a power supply when contacts of a movable piece and a fixed terminal facing each other in the housing are brought into contact with or separated from each other, the switch further including a state holding member that receives an operation force from the operating element when the operating element is ON operated to one side and that does not receive the operation force from the operating element when the operating element is OFF operated to the other side, wherein the state holding member includes a switch operating portion for turning ON the power supply switch mechanism in cooperation with the operation of the state holding member to an anti-biasing direction of the return spring upon receiving the operation force when the operating element is ON operated to one side and a return spring regulating portion for regulating the return spring in the anti-biasing direction with the turning ON of the power supply switch mechanism, a holding unit for holding a regulation state of the return spring regulated by the return spring regulating portion and holding an ON state of the power supply switch mechanism is arranged, and a release unit for releasing the ON state of the power supply switch mechanism by the holding unit at the time of power supply reset is arranged.

According to one or more embodiments of the present invention, the power supply switch mechanism is turned ON when the operating element is ON operated. Even if the power supply is OFF operated thereafter, the power supply switch mechanism does not turn OFF instantaneously to maintain the ON state until the signal of the power supply reset is inputted. That is, the power supply is automatically turned OFF after the processing data when the use of electronic device to be used is stopped is reliably stored in the hard disk and the data processing is completed, and hence the data can be reliably saved and highly reliable data management can be realized.

Because the biasing force of the return spring for biasing in the OFF direction is regulated so that the biasing force of the return spring is not applied on the operating element after the operating element is OFF operated once, the operating element can freely turn in a single body and spins around. Thus, even if the operating element is thereafter ON/OFF operated again, the re-ON/OFF operation force idles and the operation force from the operating element is not transmitted to the contact of the power supply switch mechanism. Therefore, after the operating element is OFF operated the first time, issues may not arise even if the operating element is thereafter ON/OFF operated again carelessly and excelling use of the data management can be achieved.

According to an aspect of one or more embodiments of the present invention, the state holding member is turnably attached on an inner side of the operating element, the power supply switch mechanism includes the movable piece coupled to the state holding member through an elastic body and the fixed terminal arranged facing the movable piece, and the elastic body elastically displaces in an ON direction and an OFF direction cooperation with the turning of the state holding member and is configured to bring the movable piece into contact with and separate the movable piece from the opposing fixed terminal based on the elastic displacement of the elastic body.

According to one or more embodiments of the present invention, a coil spring that has flexible bendability not only in the axial direction but also in the crossing direction can be used for the elastic body. A configuration of transmitting the turning force of the state holding member to the movable piece through the elastic body is adopted, and in particular, the elastic body has strong durability because elastic deformation suited for turning ON/OFF can be easily realized by repeatedly bending and inverting, so that a stable switch mechanism can be ensured.

According to another aspect of one or more embodiments of the present invention, an interior operating piece is formed in the operating element and the state holding member is configured by a slider that receives the operation force from the operating element when the operating element is ON operated to one side through the interior operation piece and slides and that does not receive the operation force from the operating element when the operating element is OFF operated to the other side.

According to the present operation, a compact arrangement configuration of the switch components can be realized by using a slider for linearly advancing and retreating the operation force from the operating element, and the switch components can be efficiently incorporated in the housing in a concentrated manner. The miniaturization of the switch thus can be achieved.

According to still another aspect of one or more embodiments of the present invention, the switch further includes a signal switch mechanism, including a signal movable piece that cooperatively operates with movement when the operating element is operated, for turning ON/OFF the signal when the contacts of the movable piece and a signal fixed terminal are brought into contact with or separated from each other.

According to one or more embodiments of the present invention, the control unit of the device to be used starts the process of storing the processing data at the time of power supply OFF in the hard disk by a rising signal of the signal switch mechanism, and maintains the power supply ON state until the data processing in the device is completed because a signal is provided to the power supply reset mechanism to turn OFF the power supply switch mechanism when the process is finished, so that a highly reliable switch for automatically turning OFF the power supply after data processing is completed is obtained.

The switch configured in such a manner can be widely used in various types of electronic devices including a hard disk such as a copy machine or a personal computer as a switch excelling in data protecting function.

According to one or more embodiments of the present invention, after the operating element is manually ON operated to operate the device to be used, the power supply ON state is maintained until data processing in the device is completed even if the operating element is manually OFF operated with the stop of the operation, so that a highly reliably switch for automatically turning OFF the power supply after data processing is completed, and an electronic device can be provided.

DETAILED DESCRIPTION

Hereinafter, embodiments of the present invention will be described with reference to the drawings. In embodiments of the invention, numerous specific details are set forth in order to provide a more thorough understanding of the invention. However, it will be apparent to one with ordinary skill in the art that the invention may be practiced without these specific details. In other instances, well-known features have not been described in detail to avoid obscuring the invention.

First Embodiment

Figure 1A:
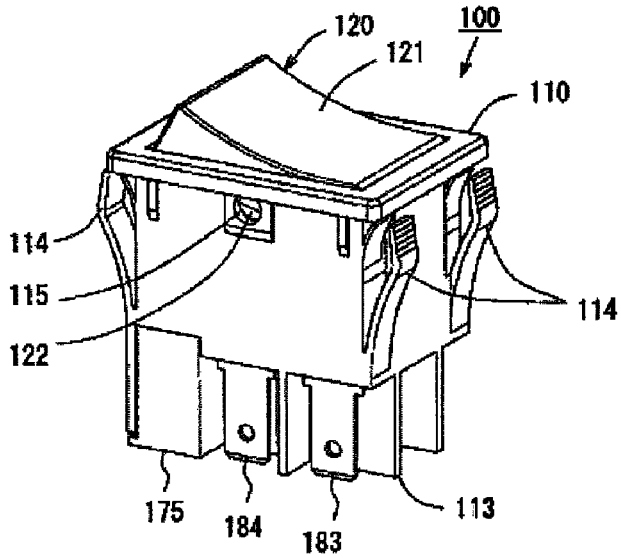
FIGS. 1A and 1B are perspective views of an outer appearance of a switch of a first embodiment.
Figure 1B:
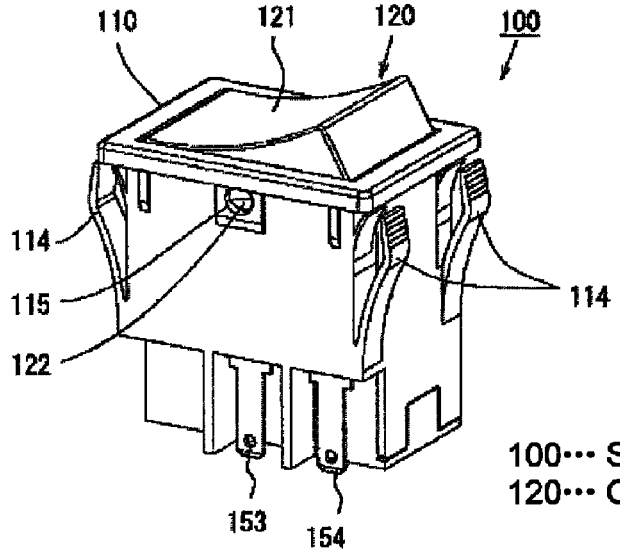
Figure 2:
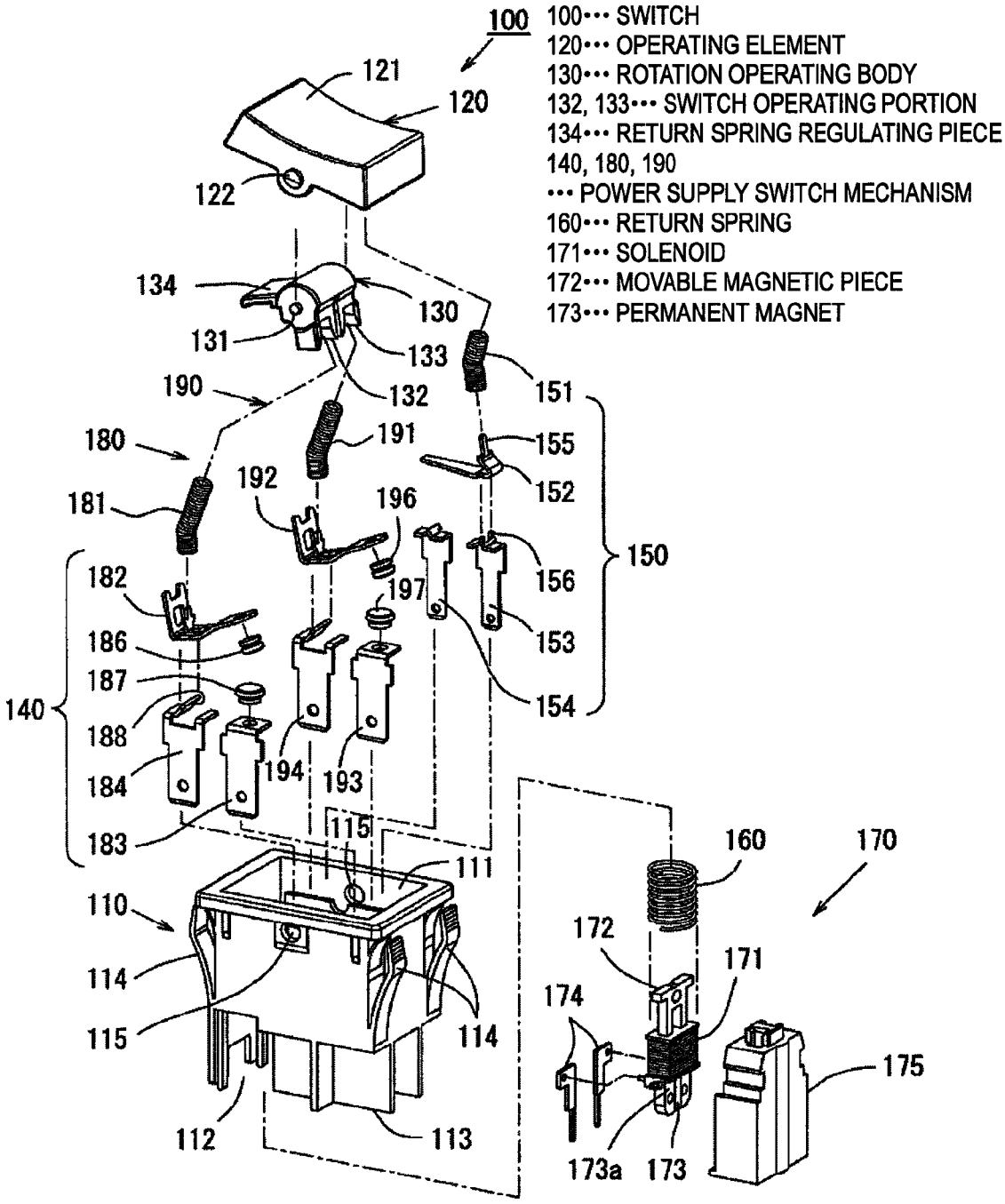
FIG. 2 is an exploded perspective view of the switch of the first embodiment seen from a diagonally upper side.
Figure 3:
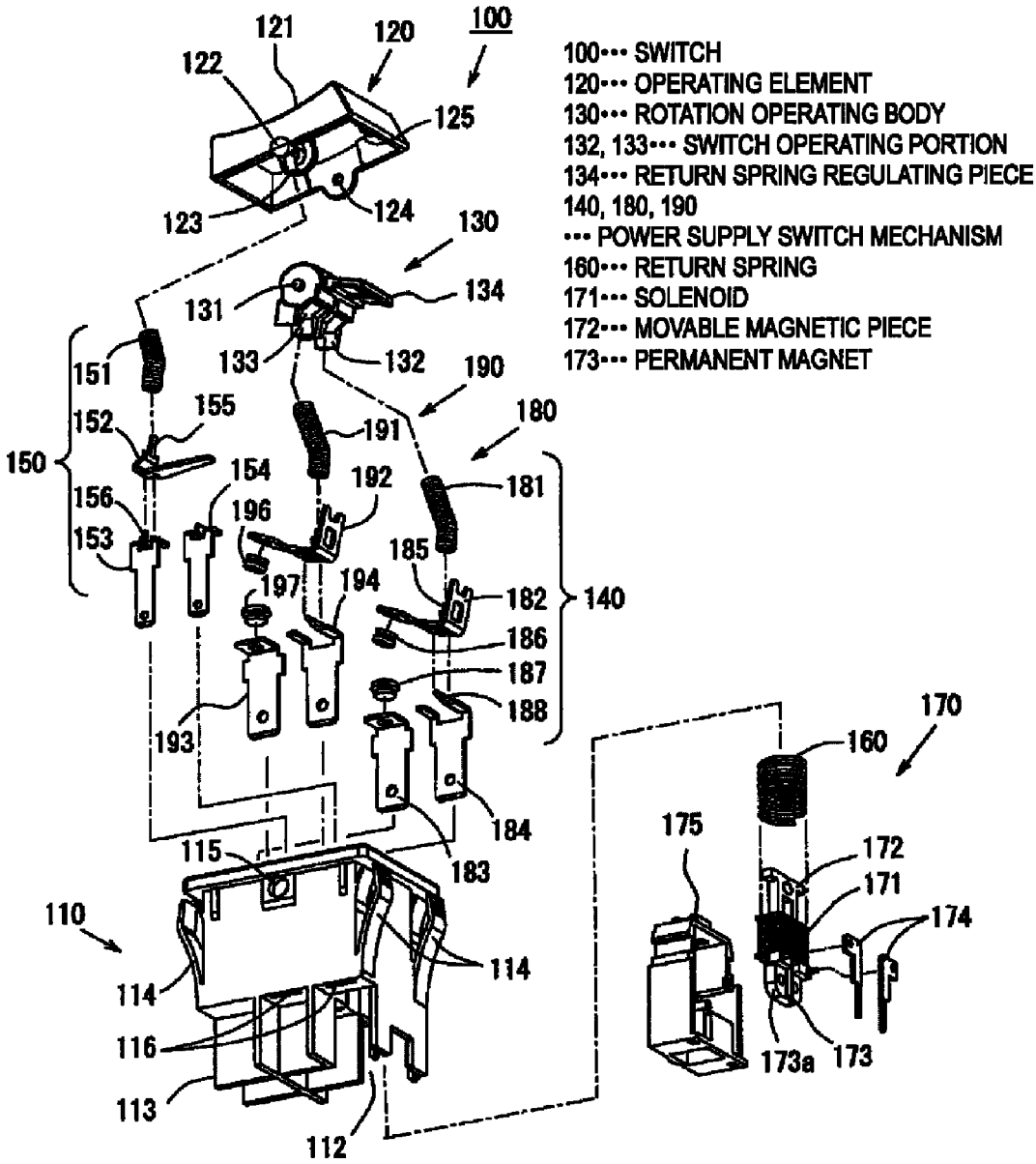
FIG. 3 is an exploded perspective view of the switch of the first embodiment seen from a diagonally lower side.

The drawings show a switch with a reset function, where FIG. 1A shows a perspective view of an outer appearance of a switch 100 seen from one side, and FIG. 1B shows a perspective view of the outer appearance of the switch 100 seen from the other side. FIG. 2 shows an exploded perspective view of the switch 100 seen from a diagonally upper side, and FIG. 3 shows an exploded perspective view of the switch 100 seen from a diagonally lower side.

The switch 100 having the reset function is configured to incorporate an operating element 120, a rotation operating body 130, a power supply switch mechanism 140, a signal switch mechanism 150, a return spring 160, and a power supply reset mechanism 170 in a housing 110.

The housing 110 has a box shape with the upper surface opened, where a recess shaped hollow portion 111 for incorporating the components 130, 140, 150, 160 described above is provided on the upper side, and a bottom attachment portion 112 and a terminal partitioning portion 113 for incorporating the power supply reset mechanism 170 from the lower side are provided on the bottom side. The operating element 120 that planarly closes with respect to the open surface of the hollow portion 111 is turnably attached after incorporating the components to the hollow portion 111 opened on the upper side.

Elastic lock pieces 114 for slip out preventing attachment projected out to fit and attach the switch 100 are arranged on both outer side surfaces having a narrow width of the housing 110. Pivot holes 115 for turnably supporting the operating element 120, to be described later, are arranged at central parts on both sides of the outer side surface having a wide width of the housing 110.

The operating element 120 is provided in a rectangular solid box shape having a bottom surface opened, the upper surface of which being a push operating surface 121 formed into a gradual recessed arcuate surface suited to be pushed with a fingertip. Furthermore, supporting shafts 122 are arranged in a projecting manner at the central parts on both sides of the outer side surface having a wide width of the operating element 120. The supporting shafts 122 are pivotally supported in a freely turning manner at the pivot holes 115 of the housing 110, so that the operating element 120 is turnably attached to the housing 110 in a see-saw manner with the pivot supporting portions on both sides as the supporting points of turn.

Furthermore, as shown in FIG. 3, the operating element 120 has coupling shafts 123 vertically arranged on one side and pivot holes 124 for pivotally supporting both sides of the rotation operation body 130, to be described later, formed on the other side on a line connecting the supporting shafts 122 on both sides in the opened internal space at the bottom surface. Further, a pushing element 125 (see FIGS. 6A to 6F) for pushing down a return spring regulating piece 134, to be described below, is vertically arranged on one side of the internal space.

The rotation operating body 130 described above is arranged as an operation member for ON/OFF operating the power supply, and is configured by a pivot shaft 131, a first switch operating portion 132, a second switch operating portion 133, and a return spring regulating piece 134.

The pivot shaft 131 is pivotally supported in a freely turning manner at the pivot hole 124 formed at the inner surface on both sides of the operating element 120. The rotation operating body 130 is thus arranged to be freely turnable separate from the turning of the operating element 120 in the operating element 120.

That is, when the operating element 120 is turned and ON operated to one side, it is pushed downward by the pushing element 125 thereby receiving the operation force from the operating element 120, whereas when OFF operated, it is not in contact and does not receive the operation force from the operating element 120.

The first switch operating portion 132 and the second switch operating portion 133 are arranged on both sides at the lower surface connecting the pivot shafts 131 on both sides of the rotation operating body 130. The first switch operating portion 132 fits to and holds the upper part of a first spring coupling body 181 arranged at the upper part of a first power supply switch mechanism 180 to be described later. The second switch operating portion 133 fits to and holds the upper part of a second spring coupling body 191 arranged at the upper part of a second power supply switch mechanism 190.

The rotation operating body 130 includes a return spring regulating piece 134 having a flat plate shape arranged in a projecting manner substantially horizontally, and is configured to push down a movable magnetic piece 172, to be described later, biased upward by the lower surface of the return spring regulating piece 134.

The power supply switch mechanism 140 has a two-series switch configuration arranged in parallel in correspondence with two circuits of the first power supply switch mechanism 180 and the second power supply switch mechanism 190.

The first power supply switch mechanism 180 is configured to include the first spring coupling body 181, a movable piece 182, a fixed terminal 183, and a common fixed terminal 184.

The first spring coupling body 181 uses a thin coil spring. The first spring coupling body 181 is coupled by fitting the upper end in the first switch operating portion 132. The lower end is coupled to the movable piece 182 so as not to slip out by inserting and fitting a fit-in projection 185, which projects out upward, of the movable piece 182 to be described later in a hole of the coil spring. The first spring coupling body 181 is formed into a dogleg shape in which the central part in the axial direction is slightly bent to one side when assembled.

The movable piece 182 is formed by bending a conducive metal plate to an L-shape, and is supported in a turnable manner at the common fixed terminal 184 to be described later with the bent portion of the L-shape as the supporting point of turn. The fit-in projection 185 is raised and formed at the intermediate portion of the movable piece 182 to securely attach a conductive contact 186 at a distal end on the horizontal piece side of the L-shape.

The fixed terminal 183 is formed by bending a conductive metal plate to a reverse L-shape, where a conductive contact 187 is securely attached to the upper surface. The vertical piece side of the reverse L-shape of the fixed terminal 183 is inserted and attached to a terminal attachment hole 116 of the housing 110. In this case, the contact 187 is arranged facing upward on the bottom surface of the housing 110 to be able to be in contact with and separate from the opposing contact 186 of the movable piece 182 on the upper side.

Similarly, the common fixed terminal 184 is formed by bending a conductive metal plate to a reverse L-shape, where a movable piece supporting portion 188 is raised and formed on the upper surface, and is inserted and attached to the terminal attachment hole 116 of the housing 110.

The first spring coupling body 181 is coupled between the first switch operating portion 132 and the movable piece 182 in the up and down direction in a dogleg shape, where when the rotation operating body 130 forming the first switch operating portion 132 is turned, the direction at the upper part supporting the first spring coupling body 181 differs one from the other on the turning path on the lower side thereby creating an angle difference that displaces so that the switch operation force with respect to the movable piece 182 on the lower side is applied.

Through the use of the first spring coupling body 181, abundant elasticity is achieved, flexible bendability can be obtained not only in the axis direction but also in the cross direction, and an elastic deformation necessary for repeatedly turning ON and OFF such as with the switch can be easily obtained. Therefore, the movable piece 182 on the lower side can be smoothly operated in the ON direction and the OFF direction by easily following the angle difference by using the first spring coupling body 181 excelling in flexibility that can follow the turning of the rotation operation body 130.

The second power supply switch mechanism 190 has the same configuration as the first power supply switch mechanism 180. Furthermore, a parallel arrangement configuration in which the first power supply switch mechanism 180 and the second power supply switch mechanism 190 simultaneously receive the operation force of one operating element 120 is adopted. Thus, the second power supply switch mechanism 190 has the same function as the first power supply switch mechanism 180 and is simultaneously executed with the ON/OFF operation. Thus, the components same as the respective components of the first power supply switch mechanism 180 are arranged. Because the same components are arranged, the description of the second power supply switch mechanism 190 including the first spring coupling body 191, the movable piece 192, the fixed terminal 193, the common fixed terminal 194, and the respective contacts 196, 197 is already made with the first power supply switch mechanism 180 and hence will be omitted.

The signal switch mechanism 150 is configured by a third spring coupling body 151, a signal moveable piece 152, a signal common fixed terminal 153, and a signal fixed terminal 154.

The third spring coupling body 151 is configured similar to the first spring coupling body 181 described above, and uses a thin coil spring. The third spring coupling body 151 is coupled to the signal movable piece 152 by fitting and coupling the spring hole at the upper end to the coupling shaft 123 vertically arranged at the lower surface of the operating element 120, and fitting the spring hole at the lower end to the fit-in projection 155 projecting upward at the upper end of the signal movable piece 152 to be described later. In this case as well, the third spring coupling body 151 is formed into a dogleg shape in which the central part in the axial direction is slightly bent to one side when assembled.

The signal movable piece 152 is formed by bending the conductive metal plate to an L-shape, and is supported in a turnable manner at the signal common fixed terminal 153 to be described later with the bent portion of the L-shape as the supporting point of turn. The fit-in projection 155 described above is arranged at the intermediate portion of the signal movable piece 152, and the distal end of the horizontal piece side of the L shape becomes the contact. The configuration of the signal switch mechanism 150 does not require a large contact different from the power supply switch mechanism 130 because a very weak current for signal is flowed.

The signal common fixed terminal 153 is formed by bending a conductive metal plate to a reverse L-shape, where the movable piece supporting portion 156 is raised and formed on the upper surface, and is inserted and attached to a terminal attachment hole 117 of the housing 110.

Similarly, the signal fixed terminal 154 is formed by bending a conductive metal plate to a reverse L-shape, where the upper surface becomes the contact, and is inserted and attached to the terminal attachment hole 117 of the housing 110.

Figure 4:
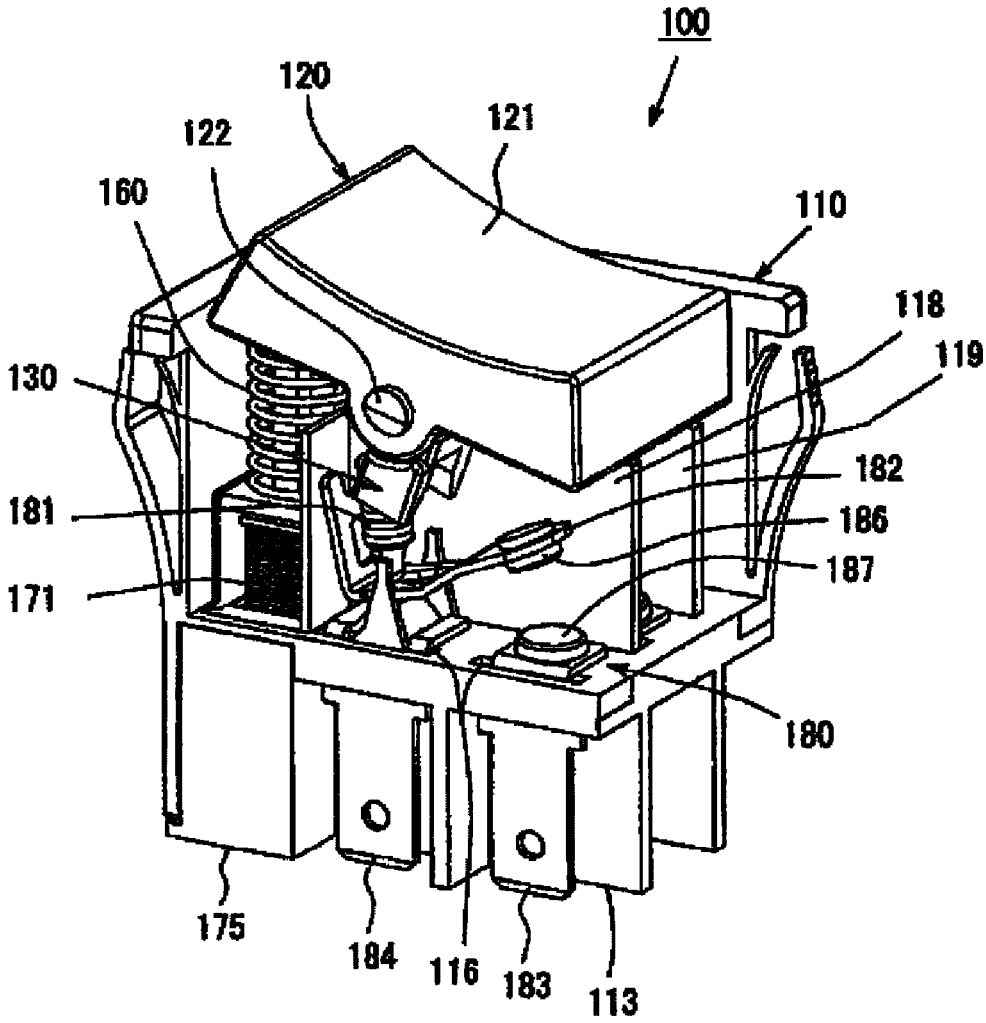
FIG. 4 is a perspective view of main parts showing a power supply switch mechanism of the first embodiment.

As shown in FIG. 4, the first power supply switch mechanism 180 and the second power supply switch mechanism 190 are partitioned by a first partition plate 118 in the housing 110. As shown in FIG. 4, the second power supply switch mechanism 190 and the signal switch mechanism 150 are partitioned by a second partition plate 119 in the housing 110. The respective switch mechanisms 180, 190, 150 ensure one sectionalized switch operation space by the inner walls of the housing 110 and the respective partition plates 118, 119.

The partition plates 118, 119 have the upper surface serving as stopper surfaces for regulating the turn to one side and the other side of the operating element 120, where ON stopper surfaces 118*a*, 119*a* are formed in an inclined manner on the upper surfaces of the partition plates 118, 119, respectively, facing one side of the operating element 120. Furthermore, OFF stopper surfaces 118*b*, 119*b* are formed in an inclined manner on the upper surfaces of the partition plates 118, 119, respectively, facing the other side of the operating element 120.

Figures 6A, 6B, 6C, 6D, 6E, 6F:
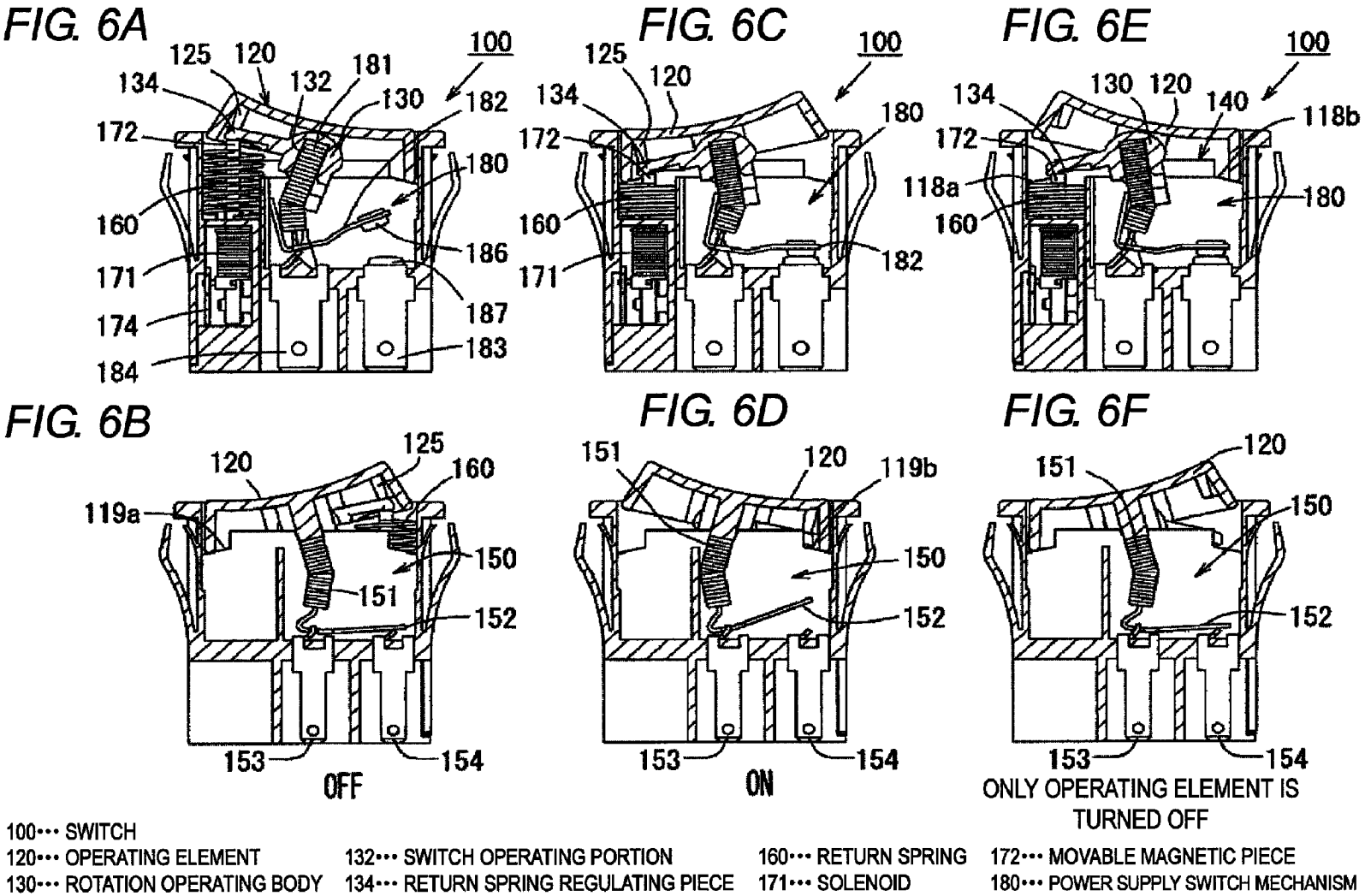
FIGS. 6A to 6F are longitudinal cross-sectional views showing an ON/OFF operation state of the switch of the first embodiment.

The return spring 160 is configured by a coil spring, and is incorporated in a power supply reset mechanism 170, to be described later. As shown in FIG. 6A, the return spring 160 is normally extended to push up the rotation operating body 130 and the operating element 120 to turn in the OFF direction.

The power supply reset mechanism 170 is configured to include a solenoid 171, a movable magnetic piece 172, a permanent magnet 173, a fixed magnetic piece (yoke) 173*a*, a reset signal input terminal 174, and a solenoid case 175.

The solenoid 171 wound coil includes an inserting portion opened in the up and down direction at the interior so that the movable magnetic piece 172, to be described later, can be inserted to the inserting portion in the up and down direction. Furthermore, the permanent magnet 173, the fixed magnetic piece 173*a*, and the reset signal input terminal 174 are arranged on the inner end side of the inserted movable magnetic piece 172.

The movable magnetic piece 172 has a T-shape, where the lower side of the T-shaped portion is arranged to be freely insertable to the inserting portion inside the coil of the solenoid 171 in two parallel columns, and the return spring 160 is interposed in a state of being compressed in the up and down direction between the T-shaped portion of the movable magnetic piece 172 and the coil side upper end face of the solenoid 171, as shown in FIGS. 6A to 6F.

When receiving the downward pushing force, the movable magnetic piece 172 moves downward against the biasing force of the return spring 160 and is inserted to the lower end, whereby the movable magnetic piece 172 is adsorbed and held by the rectangular solid permanent magnet 173 opposing at the lower side and the U-shaped fixed magnetic piece 173*a* arranged on both sides with the permanent magnet 173 in between. The power supply ON state is held by such adsorbing and holding action. When the magnetism release action is applied on the solenoid 171 in the power supply ON state, the adsorption is released thereby turning OFF the power supply.

In FIGS. 6A to 6F, FIGS. 6A, 6C, and 6E at the upper level show the ON/OFF operation state of the first power supply switch mechanism 180, and FIGS. 6B, 6D, and 6F at the lower level show the ON/OFF operation state of the signal switch mechanism 150. FIGS. 6A and 6B arranged at the left side show the OFF state, FIGS. 6C and 6D arranged at the middle show the ON state, and FIGS. 6E and 6F arranged at the right side show the state in which the only the operating element is turned OFF.

As shown in FIG. 4 and FIG. 6A, normally in the first power supply switch mechanism 180, the return spring 160 is extended in the power supply switch OFF state, so that the upper end of the movable magnetic piece 172 biased by the return spring 160 pushes up the return spring regulating piece 134 and also pushes up the operating element 120 through the pushing element 125 to bias and support at the OFF position. In this case, the rotation operating body 130 is in a state rotated in the OFF direction. In the OFF state, the power supply OFF state in which the first spring coupling body 181 is bent to an arch shape, the movable piece 182 is turned in the OFF direction, and the contact 186 of the movable piece 182 is spaced apart from the contact 187 of the fixed terminal 183 is achieved.

Figure 5:
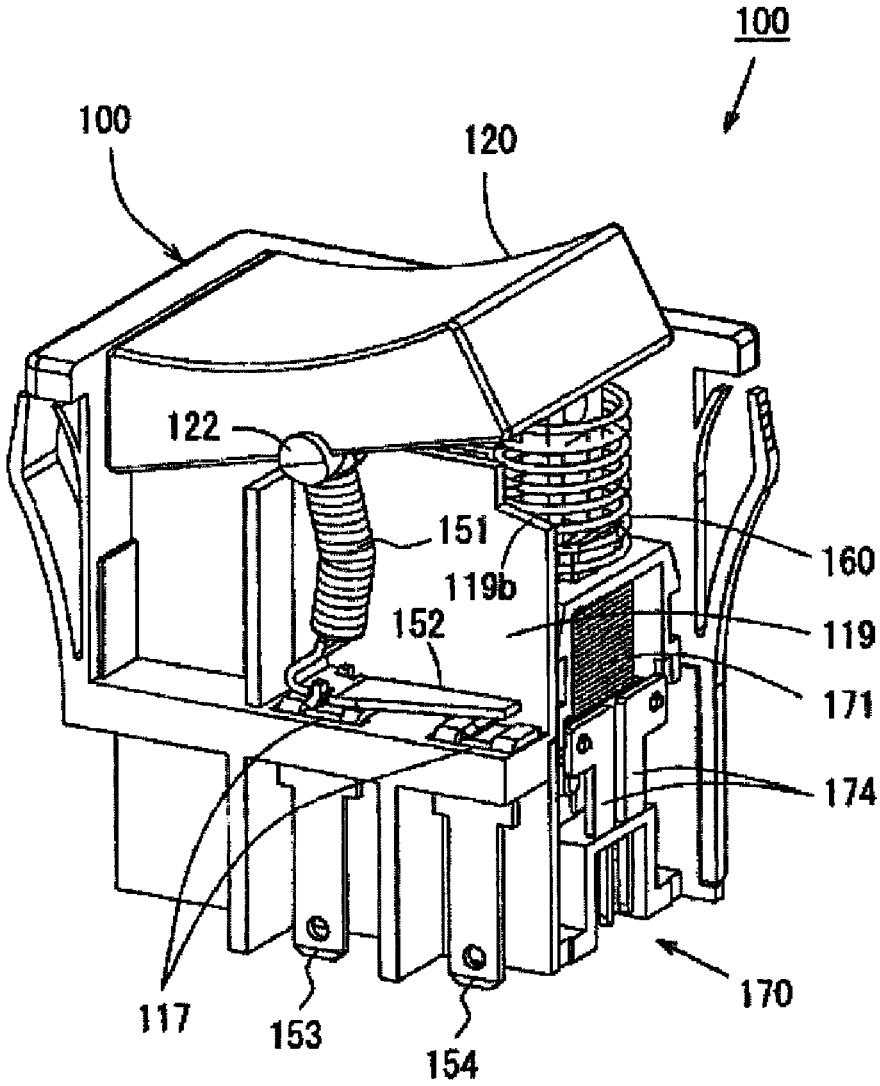
FIG. 5 is a perspective view of main parts showing a signal switch mechanism of the first embodiment.

As shown in FIG. 5 and FIG. 6B, in the signal switch mechanism 150, the third spring coupling body 151 is bent to an arch shape in a direction opposite to the first spring coupling body 181 so that the signal movable piece 152 is brought into contact with the signal fixed terminal 154 when the operating element 120 is at the OFF position. The conductive state in which the signal movable piece 152 and the signal fixed terminal 154 are brought into contact is set to OFF and the separated state is set to ON in the signal switch mechanism 150.

As shown in FIG. 6C, when the switch 100 configured as above is ON operated, the pushing element 125 of the operating element 120 pushes down the return spring regulating piece 134 and further pushes down the movable magnetic piece 172 against the biasing force of the return spring 160 when the operating element 120 is pushed in the ON direction. The movable magnetic piece 172 thereby moves downward and is inserted into the coil of the solenoid 171, and receives the magnetic attraction action of the permanent magnet 173 facing thereto on the lower side to be adsorbed. In this case, the return spring 160 is compressed and thus is held in the compressed state. The axially central part of the first spring coupling body 181 of the first power supply switch mechanism 180 reflexes in the opposite direction when the operating element 120 is ON operated, whereby the movable piece 182 turns by the reactive force thus bringing the contacts 186, 187 into contact and turning ON the power supply.

The second power supply switch mechanism 190 moves in the same way as the movement of the first power supply switch mechanism 180, and is ON operated in synchronization.

The signal switch mechanism 150 is turned ON at substantially the same time as the first power supply switch mechanism 180 and the second power supply switch mechanism 190. As shown in FIG. 6D, the signal switch mechanism 150 has the third spring coupling body 151 refluxed to an arch shape in the direction opposite to the first spring coupling body 181 with the turning of the operating element 120 in the ON direction thereby separating the signal movable piece 152 and the signal fixed terminal 154 and turning ON the signal switch mechanism 150.

As shown in FIG. 6E, the operating element 120 is push operated in the OFF direction when turning OFF the switch 100. In this case, the operating element 120 is turned in the OFF direction, but only the operating element 120 is turned, that is, spun around because the biasing force of the return spring 160 is not received on the first power supply switch mechanism 180 side.

Therefore, the rotation operating body 130 does not turn, the return spring regulating piece 134 integrated with the rotation operating body 130 maintains a state where the movable magnetic piece 172 is pushed down, and the power supply switch mechanism 140 is held in the ON state until the reset signal is inputted from the control unit.

As shown in FIG. 6F, the third spring coupling body 151 is refluxed and inverted to an arch shape with the turning of the operating element 120 in the OFF direction on the signal switch mechanism 150 side, where the signal movable piece 152 is turned therewith to again come into contact with the signal fixed terminal 154. Thus, the signal switch mechanism 150 is ON/OFF operated with the movement of the operating element 120.

When the signal switch mechanism 150 is turned OFF, the reset signal from the control unit (not shown) receiving the OFF signal is waited. The first power supply switch mechanism 180 shown in FIG. 6E again returns from the ON state to the original power supply OFF state shown in FIG. 6A at the time point the storage process of the control data to be stored by the hard disk is completed.

Figure 7:
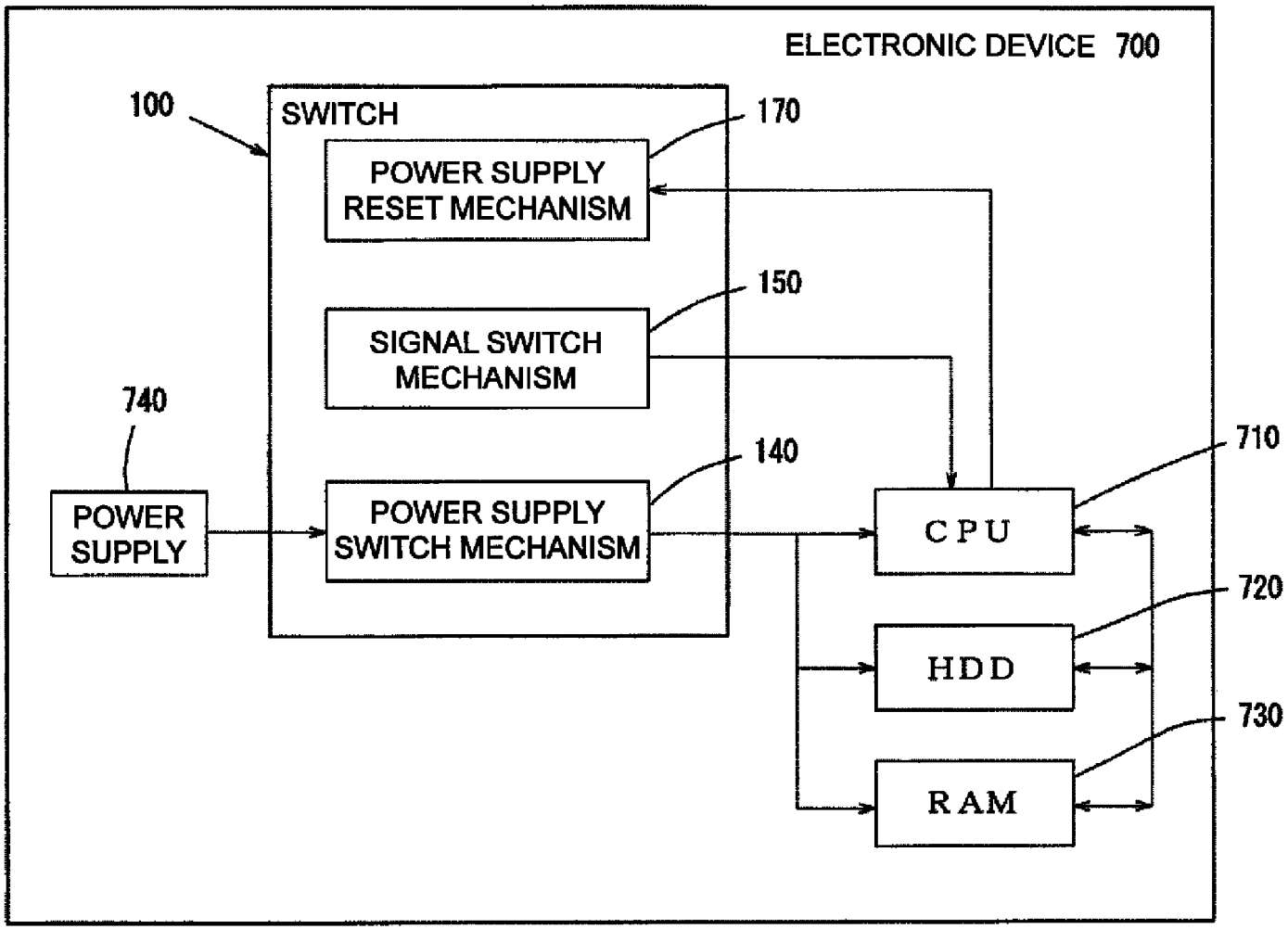
FIG. 7 is a control block diagram showing a data processing state in an electronic device of the first embodiment.

The data processing operation of an electronic device 700 including the switch 100 will now be described with reference to a control block diagram of FIG. 7.

The electronic device 700 has the switch 100 arranged at the ON/OFF operable position, and interiorly includes a CPU 710, a HDD (hard disk) 720, and a RAM 730.

When the operating element 120 of the switch 100 is ON operated, the rotation operating body 130 is turned in the ON direction in response to the operation force, so that the power supply switch mechanism 140 brings the contacts 186, 187, 196, 197 into contact based thereon to turn ON the switch 100 and turn ON the power supply 740 of the electronic device 700. In a state the electronic device 700 is operated in such manner, the CPU 710 stores the processing data of the electronic device 700 in the RAM 730.

When the user operates the operating element 120 of the switch 100 in the OFF direction to stop the use of the electronic device 700, an usage OFF signal is inputted from the signal switch mechanism 150 of the switch 100 to the CPU 710. The CPU 710 holds the power supply ON state until the data processing is completed on the basis thereof, and the power supply OFF signal is not outputted to the power supply reset mechanism 170. In this case, the power supply is in the ON state, and the CPU 710 first reads out the data stored in the RAM 730 and transfers all such data to the HDD 720 for storing.

After the transfer of the data to the HDD 720 is completed, the CPU 710 prioritizes the protection of data and outputs the power supply OFF signal to the power supply reset mechanism 170 of the switch 100 when ensured. On the basis thereof, the electromagnetic release force greater than the magnetic force of the permanent magnet 173 is applied to the solenoid 171 in the switch 100, so that the solenoid 171 releases the regulation of the movable magnetic piece 172 adsorbed to the permanent magnet 173 and the fixed magnetic piece 173*a* so that the movable magnetic piece 172 is in a free state, whereby the movable magnetic piece 172 pushes up the rotation operating body 130 in response to the biasing force at which the return spring 160 extends thereby turning the operating element 120 to the OFF position and separating the contacts 186, 187, 196, 197 of the power supply switch mechanism 140. The power supply is then turned OFF. The CPU 710 thus automatically turns OFF the power supply when completion of data processing is confirmed after the operating element 120 is OFF operated.

Figure 8:
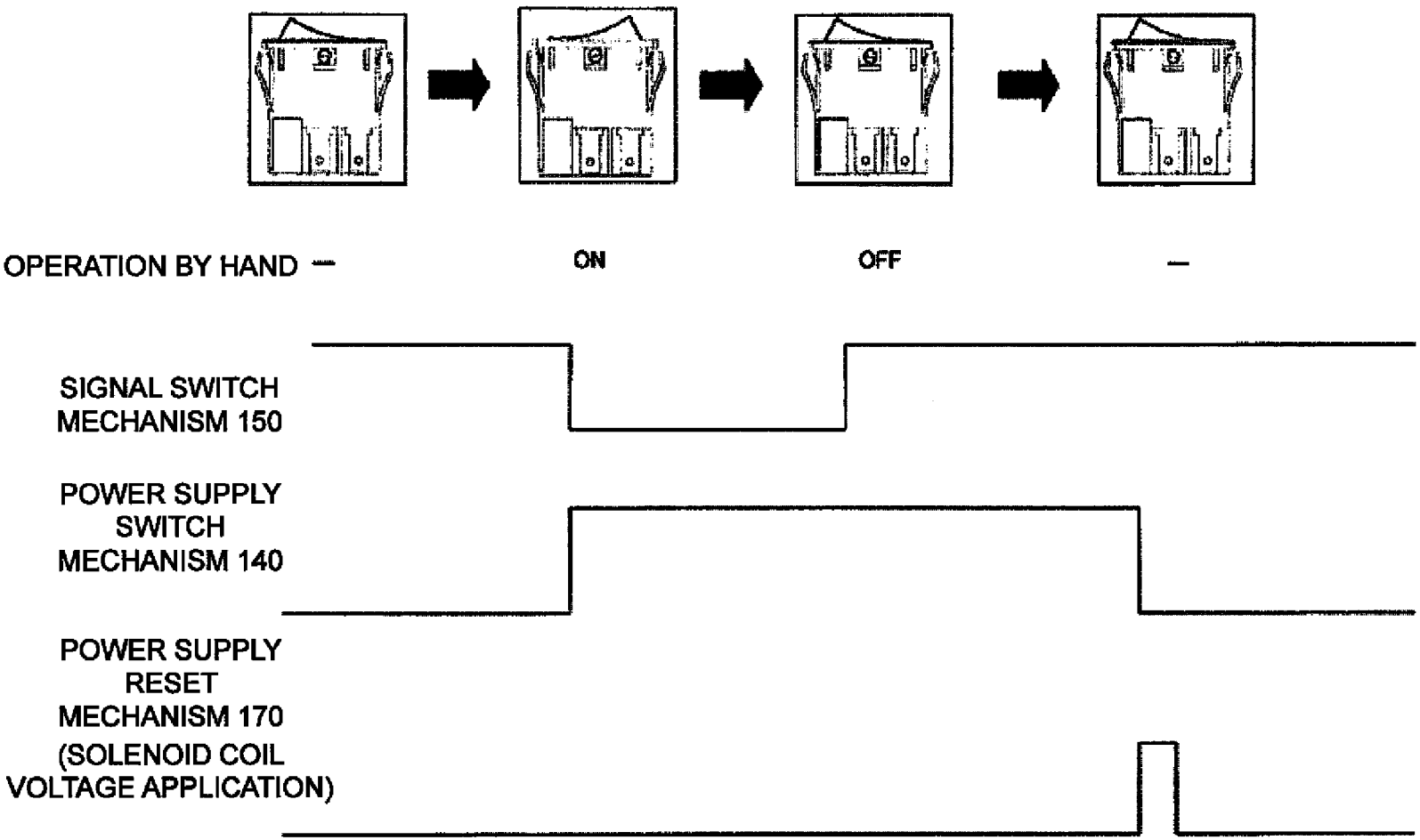
FIG. 8 is a time chart showing the ON/OFF operation state of the switch of the first embodiment.

The reset operation of the switch 100 will be described with reference to the time chart of FIG. 8.

In a standby state in which the user is not operating the operating element 120, the signal switch mechanism 150 flows a very weak current and outputs the OFF signal. The first power supply switch mechanism 180 and the second power supply switch mechanism 190 of the power supply switch mechanism 140, on the other hand, maintain an OFF state without current flow.

When the user ON operates the operating element 120 thereafter, the signal switch mechanism 150 is turned ON when the contacts are separated and the no-current flow is detected, whereas the power supply switch mechanism 140 is in the power supply ON state when the contacts are brought into contact thus flowing current. As the state is the ON state, the solenoid 171 of the power supply reset mechanism 170 maintains the ON state until a reset signal is inputted from a control unit of the electronic device 700 such as a copy machine or a personal computer where the switch 100 is provided.

When the user OFF operates the operating element 120 of the switch 100 with the stopping of the usage of the electronic device 700 after the switch 100 is turned ON and the electronic device is used, the signal switch mechanism 150 is turned OFF at the relevant time point and the OFF signal is outputted. When such OFF output is detected by the control unit (CPU) 710 of the electronic device 700, the write of storing the processing data up to the relevant point in the hard disk is executed.

After the write is completed, the reset signal is outputted from the control unit, and the electromagnetic release force greater than the adsorption force of the permanent magnet 173 is applied to the solenoid 171. The return spring 160 extends based on such release, and the release operation with respect to the power supply switch mechanism 140 is carried out based on the extended biasing force. The rotation operating body 130 and the operating element 120 return to the original OFF position in cooperation thereto.

As described above, the power supply switch mechanism is turned ON when the operating element is ON operated. The power supply switch mechanism thereafter maintains the ON state until the power supply reset signal is inputted even if the power supply is OFF operated, and thus is not immediately turned OFF. The necessary data is written to the hard disk in the meantime, and the power supply is automatically turned OFF when the data processing is completed.

The operating element spins around once the operating element is OFF operated because the biasing force of the return spring is regulated so that the biasing force of the return spring is not applied on the operating element. Therefore, even if the operating element is again ON/OFF operated after the OFF operation, such re-ON/OFF operation force go around in circles and is not transmitted to the contact of the power supply switch mechanism. Therefore, issues may not arise after the operating element is first OFF operated even if the operating element is thereafter again ON/OFF operated carelessly. Furthermore, highly reliable data management can be carried out when such a switch is used in the electronic device.

Second Embodiment

Figure 9A:
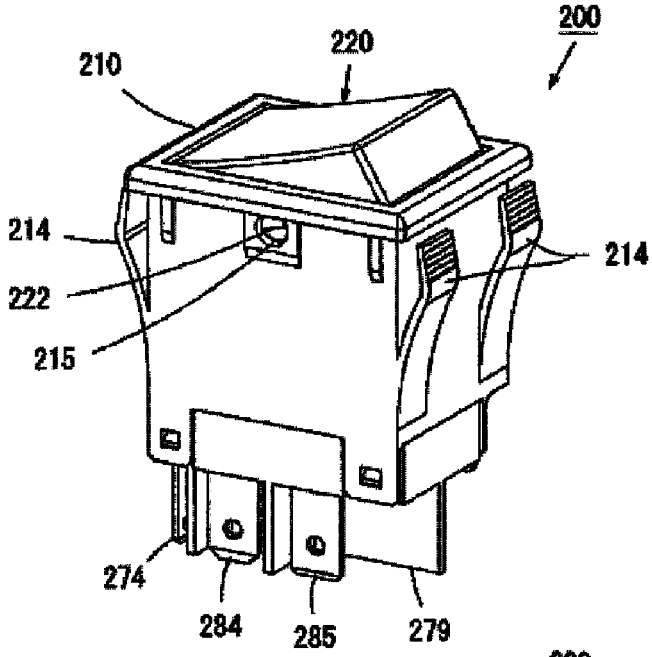
FIGS. 9A and 9B are perspective views of an outer appearance of a switch of a second embodiment.
Figure 9B:
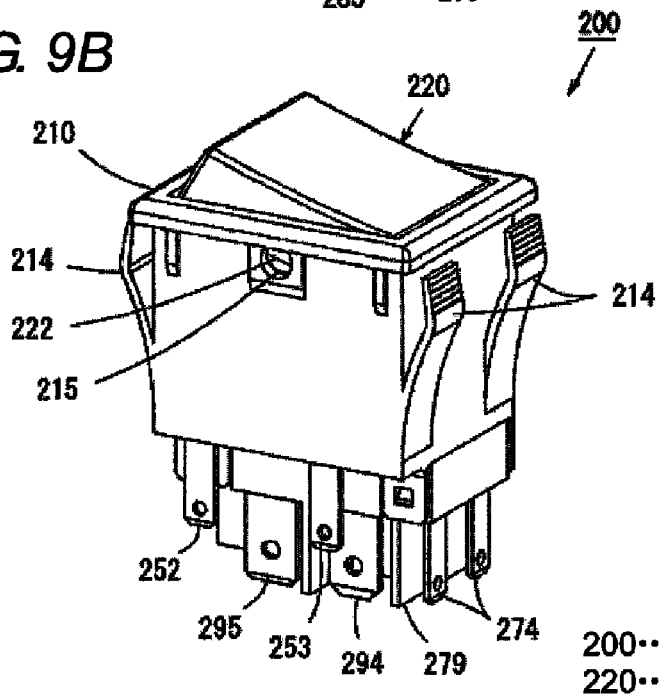
Figure 10:
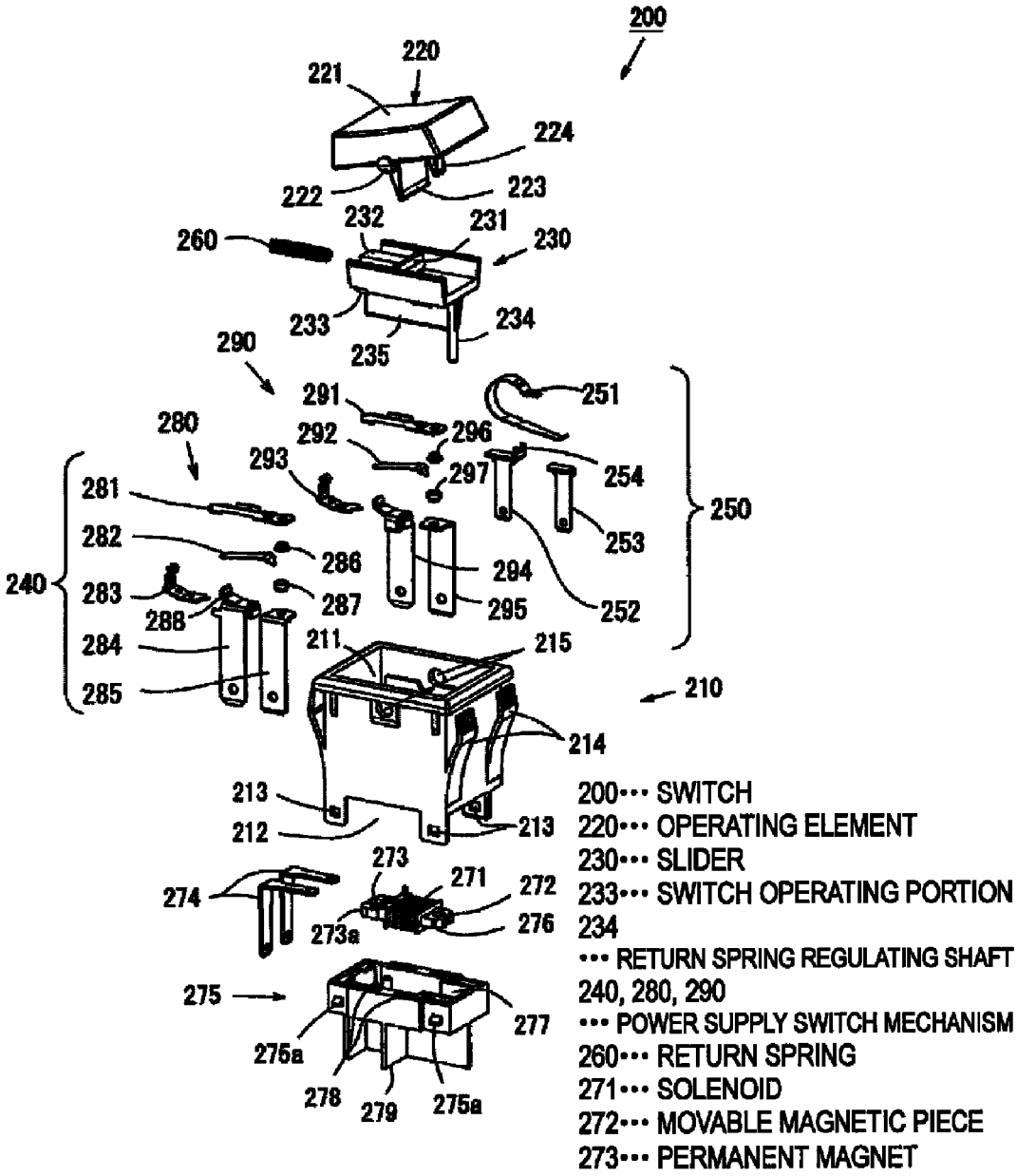
FIG. 10 is an exploded perspective view of the switch of the second embodiment seen from a diagonally front side.
Figure 11:
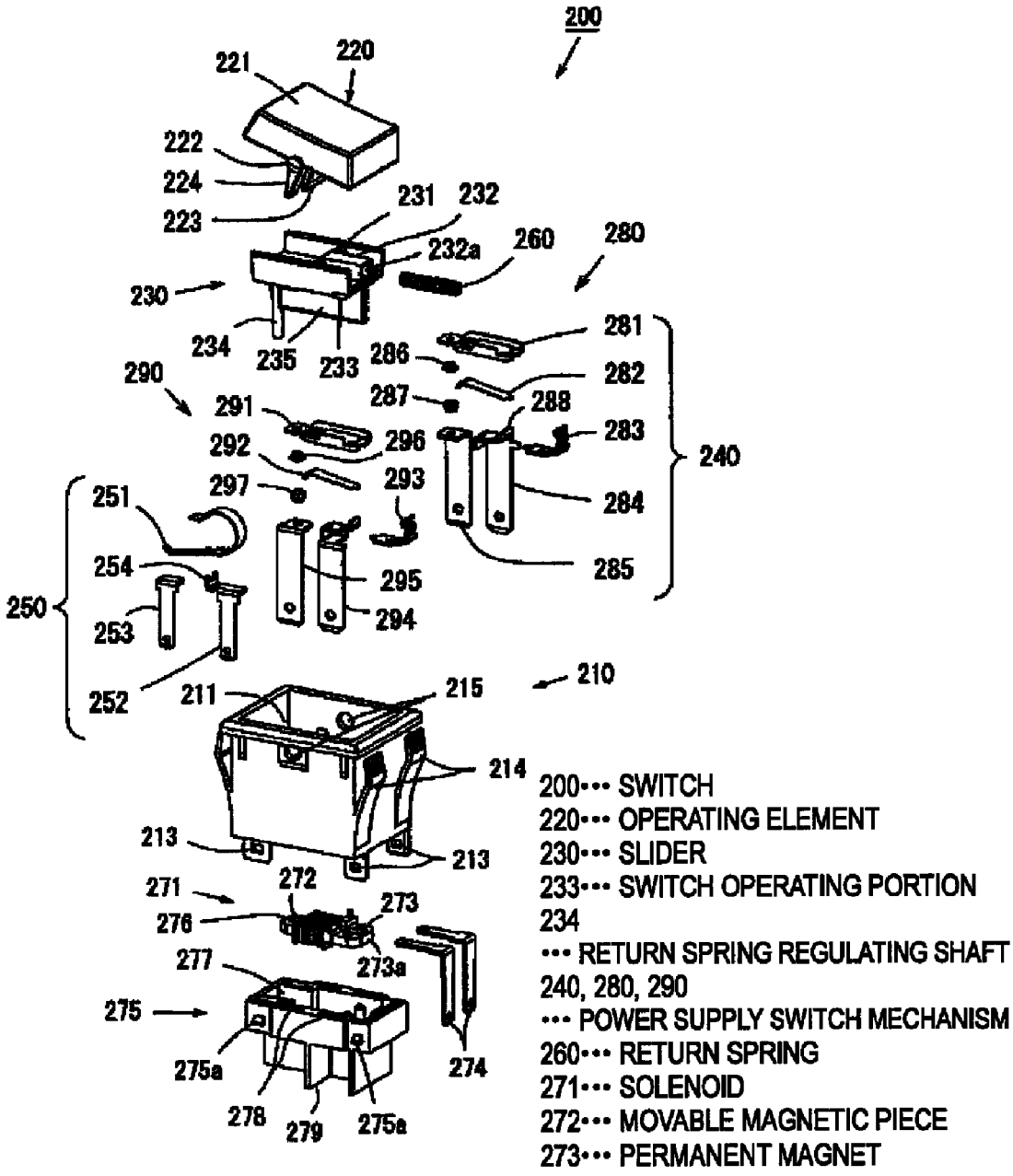
FIG. 11 is an exploded perspective view of the switch of the second embodiment seen from a diagonally back side.

The drawings show a switch 200 having a reset function. FIG. 9A shows a perspective view of the outer appearance of the switch 200 seen from one side and FIG. 9B shows a perspective view of the outer appearance of the switch 200 seen from the other side. FIG. 10 shows an exploded perspective view of the switch 200 seen from one side, and FIG. 11 shows an exploded perspective view of the switch 200 seen from the other side.

The switch 200 having the reset function is configured to incorporate an operating element 220, a slider 230, a power supply switch mechanism 240, a signal switch mechanism 250, a return spring 260, and a power supply reset mechanism 270 in a housing 210.

The housing 210 has a box shape with the upper surface opened, where a recess shaped hollow portion 211 for incorporating the components 230, 240, 250, 260 described above is provided on the upper side, and the bottom side is opened to the lower side to include a bottom attachment opening 212 and a solenoid case lock hole 213 for incorporating the power supply reset mechanism 270 from the lower side. The operating element 220 that planarly closes with respect to the open surface of the hollow portion 211 is attached in a freely turning manner after incorporating the components to the hollow portion 211 opened on the upper side.

Elastic lock pieces 214 for slip out preventing attachment for fitting and attaching the switch 200 are projected out in parallel to each other at both outer side surfaces having a narrow width of the housing 210. Pivot holes 215 for supporting the operating element 220, to be described later, in a turnable manner are arranged at central parts on both sides of the outer side surface having a wide width of the housing 210.

The operating element 220 is provided in a rectangular solid box shape having a bottom surface opened, the upper surface of which being a push operating surface 221 formed into a gradual recessed arcuate surface suited to be pushed with a fingertip. Furthermore, supporting shaft 222 are arranged in a projecting manner at the central parts on both sides of the outer side surface having a wide width of the operating element 220. The supporting shafts 222 are pivotally supported in a freely turning manner at the pivot holes 215 of the housing 210, and the operating element 220 is turnably attached to the housing 210 in a see-saw manner with the pivot supporting portions on both sides as the supporting points of turn.

Figure 12:
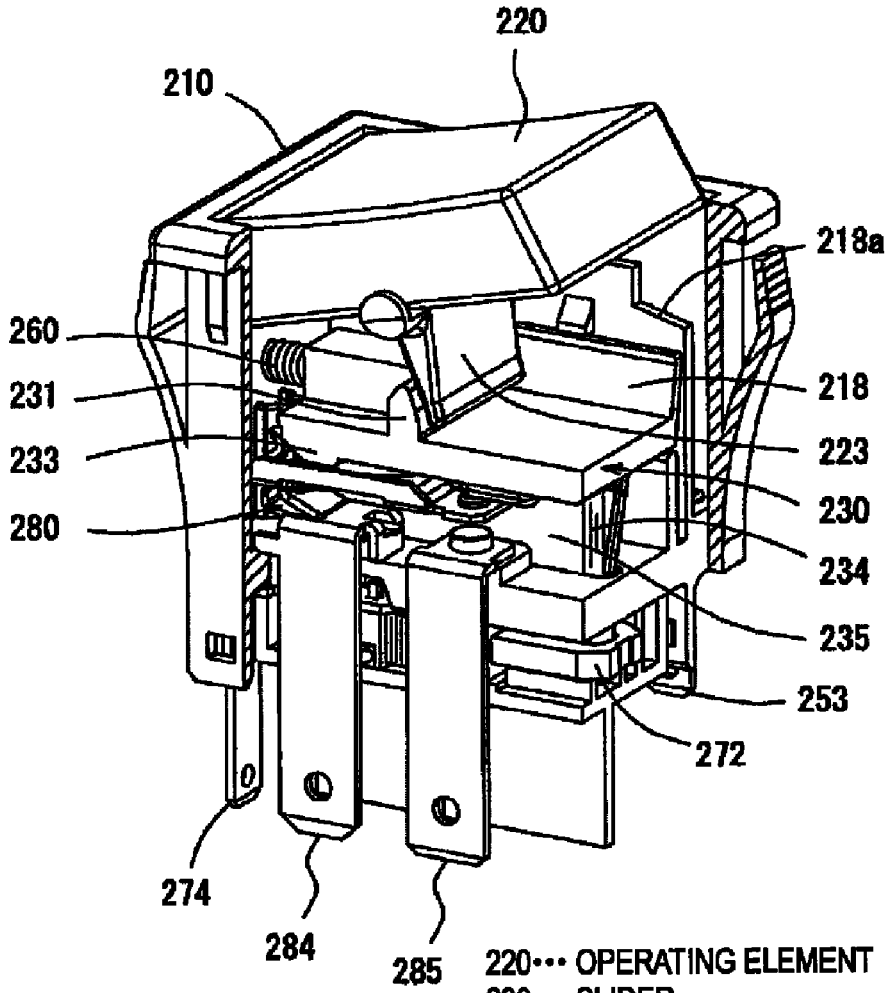
FIG. 12 is a perspective view of main parts showing a power supply switch mechanism of the second embodiment.

Furthermore, as shown in FIG. 12, the operating element 220 has an interior operation piece 223 having a wide width and projected to a V-shape vertically arranged on one side and a signal interior operation piece 224 having a narrow width and projected to a V-shape vertically arranged on the other side on a line connecting the supporting shafts 222 on both sides in the opened internal space at the bottom surface.

The slider 230 is arranged as an operation member for ON/OFF operating the power supply with the sliding operation, and is configured by a pressure receiving portion 231, a return spring accommodating portion 232, a switch operating portion 233, a return spring regulating shaft 234, and a first partitioning plate 235.

The pressure receiving portion 231 is formed at a central part of the upper surface of the slider 230 having a rectangular solid shape that is horizontally long. The pressure receiving portion 231 has a configuration in which the central wall of a recessed space formed on one side (right side in FIG. 10) of the upper surface of the slider 230 is assumed as the pressure receiving portion 231, and the planar portion at the lower end of the interior operation piece 223 is opposed to the pressure receiving portion 231 to be brought into contact at the time of turning.

Therefore, the slider 230 is sled and ON operated when the operating element 220 is turned to one side and the interior operation piece 223 pushes the slider 230. The slider 230 does not receive the operation force when the operating element 220 is turned to the other side and OFF operated.

The return spring accommodating portion 232 is formed on the upper surface of the slider at the position on the side opposite to the pressure receiving portion 231 (left side in FIG. 10). The return spring accommodating portion 232 assumes the portion having a spring insertion hole 232*a* in which the space to the pressure receiving portion 231 at the central part from the outer end face of the slider 230 is formed hollow as the return spring accommodating portion 232 in the sliding direction. The coil spring shaped return spring 260 is inserted to such return spring accommodating portion 232. The return spring 260 has the outer end facing the inner wall surface of the housing 210 and the inner end facing the inner end wall of the spring insertion hole 232*a*, so that the return spring 260 is supported in a horizontally compressed state between the opposing surfaces. The slider 230 is thus biased in the OFF direction (right side in FIG. 10) by the return spring 260.

As shown in FIG. 12, the switch operating portion 233 assumes a projection projecting to the lower surface on one side in the sliding direction of the slider 230 as the switch operating portion 233. The switch operating portion 233 slides to the ON position when the slider 230 is sled against the biasing force of the return spring 260 upon receiving the operation force of the interior operation piece 223, thus turning ON the power supply switch mechanism 240. The power supply switch mechanism 240 is turned OFF when the slider 230 is sled to the OFF position upon receiving the biasing force of the return spring 260.

The return spring regulating shaft 234 is configured to be vertically arranged at the lower end on the other side of the slider 230 that becomes the end on the opposite side from the switch operating portion 233. The return spring regulating shaft 234 slides the movable magnetic piece 272 in the sliding direction by fitting the lower end to the movable magnetic piece 272, to be described later.

The first partitioning plate 235 vertically arranged at the lower surface of the slider 230 is a plate that partitions the two sets of parallel power supply switch mechanisms 280, 290, to be described later, facing each other at the lower part of the slider 230.

The power supply switch mechanism 240 merely needs to be a configuration for obtaining a compact contact structure, and a switch structure such as a micro-switch in which the stroke operation in the up and down direction can be reduced may be used. As a specific example, a configuration of turning ON/OFF is provided in parallel to the double mechanism of the first power supply switch mechanism 280 and the second power supply switch mechanism 290.

The first power supply switch mechanism 280 is configured by arranging a movable piece 281, a contact bias spring 282, a receiver fitting 283, a common fixed terminal 284, and a fixed terminal 285 in a horizontal state to narrow the arrangement space in the up and down direction.

The movable piece 281 is formed by a conductive metal plate, and is supported in a turnable manner at a supporting point piece 288 of the common fixed terminal 284, to be described later, with the basal end side as the supporting point of turn. A conductive contact 286 is fixedly attached at the distal end.

The contact bias spring 282 has the basal end locked to the supporting point piece 288 raised at the upper part of the common fixed terminal 284 with the distal end engaged to the distal end engagement part of the movable piece 281. The movable piece 281 is thereby biased to the upper side (separating direction).

The receiver fitting 283 has an L shape, where the upper end is at a position facing the switch operating portion 233 and the lower end is supported by the supporting point piece 288 serving as the base point while supporting the movable piece 281.

The common fixed terminal 284 is formed into a reverse L shape with a conductive metal plate, where the movable piece 281 and the receiver fitting 283 are supported, while allowing oscillation, by the supporting point piece 288 formed in a raised manner at the upper part. The lower part is inserted and attached to the terminal attachment hole of the solenoid case, to be described later.

Similarly, the fixed terminal 285 is formed into a reverse L shape with a conductive metal plate, where the conductive contact 287 is fixedly attached on the upper surface and a vertical piece side of the reverse L shape is inserted and attached to the terminal attachment hole 278 of the solenoid case, to be described later, so that the contact 287 is arranged facing the contact 286 of the movable piece 281.

The second power supply switch mechanism 290 has a configuration similar to that of the first power supply switch mechanism 280. Furthermore, the parallel arrangement configuration in which the operation force of one operating element 220 is simultaneously received by the switch mechanisms 280, 290 is adopted, and the same function is executed. Therefore, the second power supply switch mechanism 290 is configured by arranging the respective components including the movable piece 291, the contact bias spring 292, the receiver fitting 293, the common fixed terminal 294, the fixed terminal 295, and the respective contacts 296, 297 having the same shape and same function similar to those of the first power supply switch mechanism 280, and hence the same description of the second power supply switch mechanism 290 will be omitted.

Figure 13:
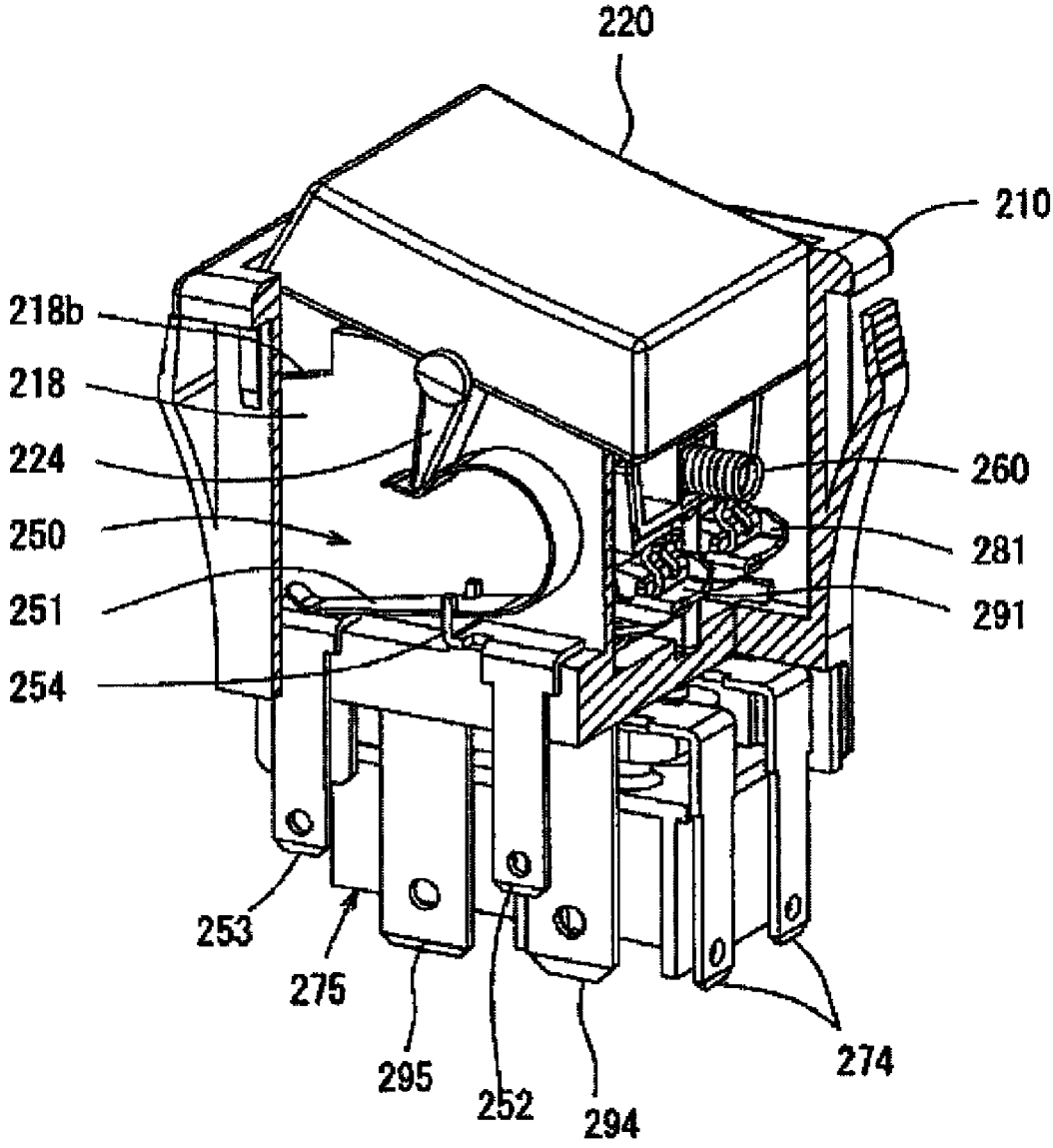
FIG. 13 is a perspective view of main parts showing a signal switch mechanism of the second embodiment.

As also shown in FIG. 13, the signal switch mechanism 250 is configured by a signal movable piece 251, a signal common fixed terminal 252, and a signal fixed terminal 253.

The signal movable piece 251 is formed by bending the conductive metal plate to a C-shape, where the lower part of the C-shape is supported by the signal common fixed terminal 252, to be described later, as the supporting point of turn. The lower end of the signal interior operation piece 224 is in contact with the upper part of the signal movable piece 251, and the horizontal piece side of the lower part of the C-shape is extended, the distal end of which being the contact. The configuration of the signal switch mechanism 250 does not require a large contact different from the power supply switch mechanism 230 because a very weak current for signal is flowed.

Figures 15A, 15B, 15C, 15D, 15E, 15F:
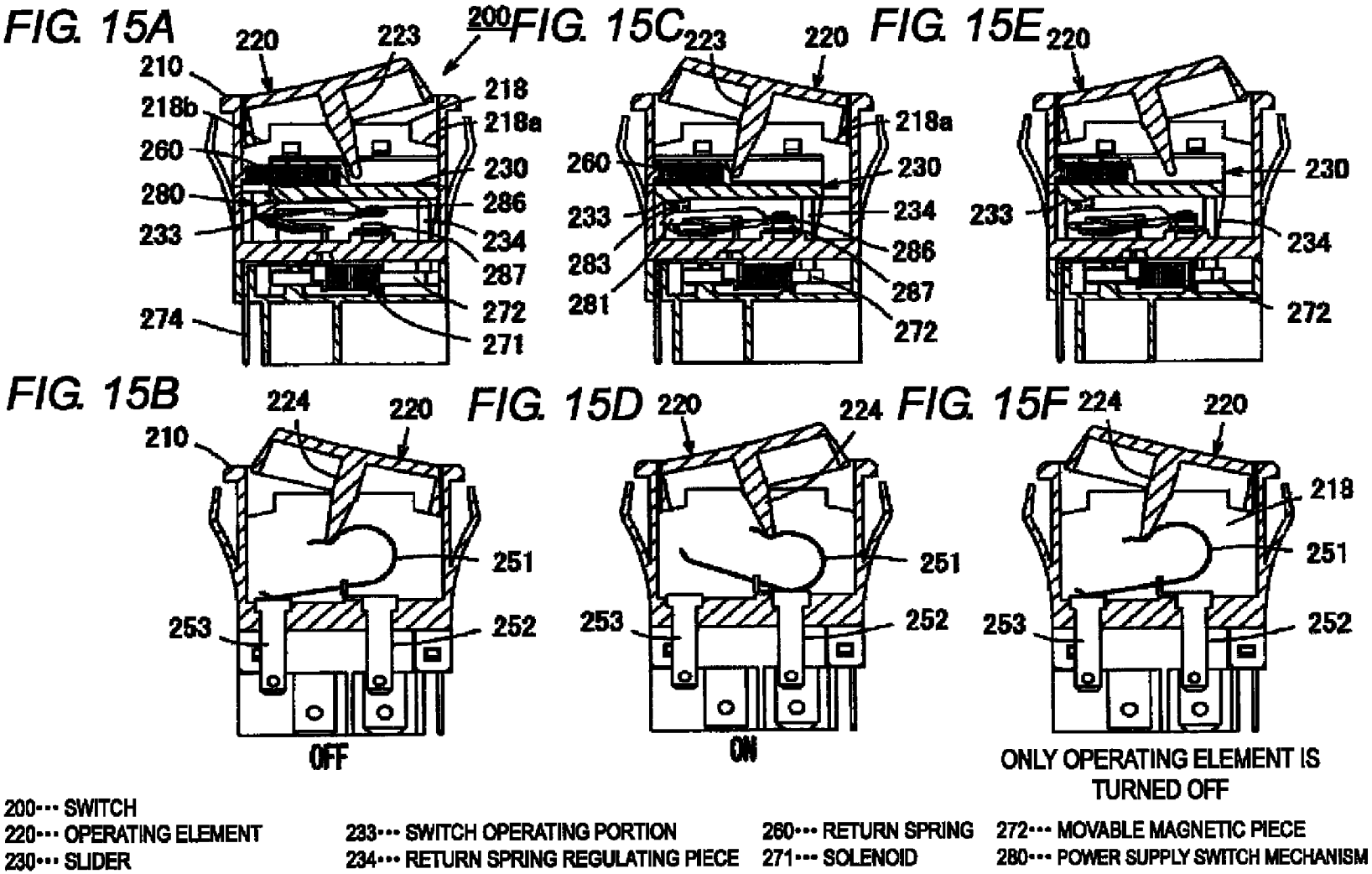
FIGS. 15A to 15F are longitudinal cross-sectional views showing an ON/OFF operation state of the switch of the second embodiment.

As shown in FIGS. 15B, 15D, 15F, the signal movable piece 251 is easily elastically deformed by the elastic action of the plate spring, so that the signal movable piece 251 is brought into contact with and separated from the signal fixed terminal 253 in cooperation with the turning operation of the orating element 220. Thus, the signal switch mechanism 250 is also turned ON/OFF in cooperation with the ON/OFF of the operating element 220.

The signal common fixed terminal 252 is formed by bending a conductive metal plate to a reverse L-shape, where the movable piece supporting portion 254 is raised and formed on the upper surface, and the lower part is held and attached at the housing 210.

Similarly, the signal fixed terminal 253 is formed by bending a conductive metal plate to a reverse L-shape, where the upper surface becomes the contact and the lower part is held and attached at the housing 210.

As also shown in FIG. 12, the first power supply switch mechanism 280 and the second power supply switch mechanism 290 are partitioned by a first partition plate 235 vertically arranged on the lower surface of the slider 230 in the housing 210.

As shown in FIG. 13, the second power supply switch mechanism 290 and the signal switch mechanism 250 are partitioned by a second partition plate 218 in the housing 210. The respective switch mechanisms 280, 290, 250 thus ensure one sectionalized switch operation space by the inner walls of the housing 210 and the respective partition plates 235, 218.

The second partition plate 218 has the upper surface acting as a stopper surface for regulating the turn to one side and the other side of the operating element 220, where an ON stopper surface 218*a* is formed in an inclined manner on the upper surfaces of the second partition plate 218 facing the one side of the operating element 220. Furthermore, an OFF stopper surface 218*b* is formed in an inclined manner on the upper surface of the second partition plate 218 facing the other side of the operating element 220.

The power supply reset mechanism 270 is configured to include a solenoid 271, a movable magnetic piece 272, a permanent magnet 273, a fixed magnetic piece 273*a*, a reset signal input terminal 274, and a solenoid case 275.

The solenoid 271 wound with a coil includes an inserting portion in the horizontal direction at the interior so that the movable magnetic piece 272, to be described later, can be inserted to the inserting portion. Furthermore, the permanent magnet 273, the fixed magnetic piece 273*a*, and the reset signal input terminal 274 are arranged on the inner end side of the movable magnetic piece 272 inserted into the coil.

The movable magnetic piece 272 includes a coupling hole 276, where the lower part of the return spring regulating shaft 234 arranged vertically at the lower part of the slider 230 is inserted to the coupling hole 276 so that the slider 230 and the movable magnetic piece 272 vertically slide in the same direction. The inner end side of the movable magnetic piece 272 is arranged in a freely insertable manner in the inserting portion inside the coil of the solenoid 271 where the return spring 260 is compressed in the horizontal direction when the movable magnetic piece 272 is sled to one side and the regulation of the return spring 260 is released when sled to the other side.

When the movable magnetic piece 272 is sled against the biasing force of the return spring 260 through the return spring regulating shaft 234 and inserted to the inner end of the inserting portion, it is adsorbed and held by the U-shaped fixed magnetic piece 23*a* arranged on both sides with the permanent magnet 273 of rectangular solid shape facing in the sliding direction in between, the adsorption being released by the magnetism canceling action of the solenoid 271.

The solenoid case 275 is attached to the open part of the lower surface of the housing 210 from the lower side, where a recessed space 277 for horizontally accommodating and holding the solenoid 271 is arranged at the central part of the upper surface, and a terminal insertion hole 278 is formed on both sides. A terminal partitioning portion 279 is formed at the bottom, and a lock projection 275*a* is arranged on both side surfaces.

The solenoid case 275 is integrated and coupled to the housing 210 by locking the lock projection 275*a* to the solenoid case lock hole 213 formed at the lower part of the housing 210.

In FIGS. 15A to 15F, FIGS. 15A, 15C, and 15E at the upper level show the ON/OFF operation state of the first power supply switch mechanism 280, and FIGS. 15B, 15D, and 15F at the lower level show the ON/OFF operation state of the signal switch mechanism 250. FIGS. 15A and 15B arranged at the left side show the OFF state, FIGS. 15C and 15D arranged at the middle show the ON state, and FIGS. 15E and 15F arranged at the right side show the state in which the only the operating element is turned OFF.

Figure 14:
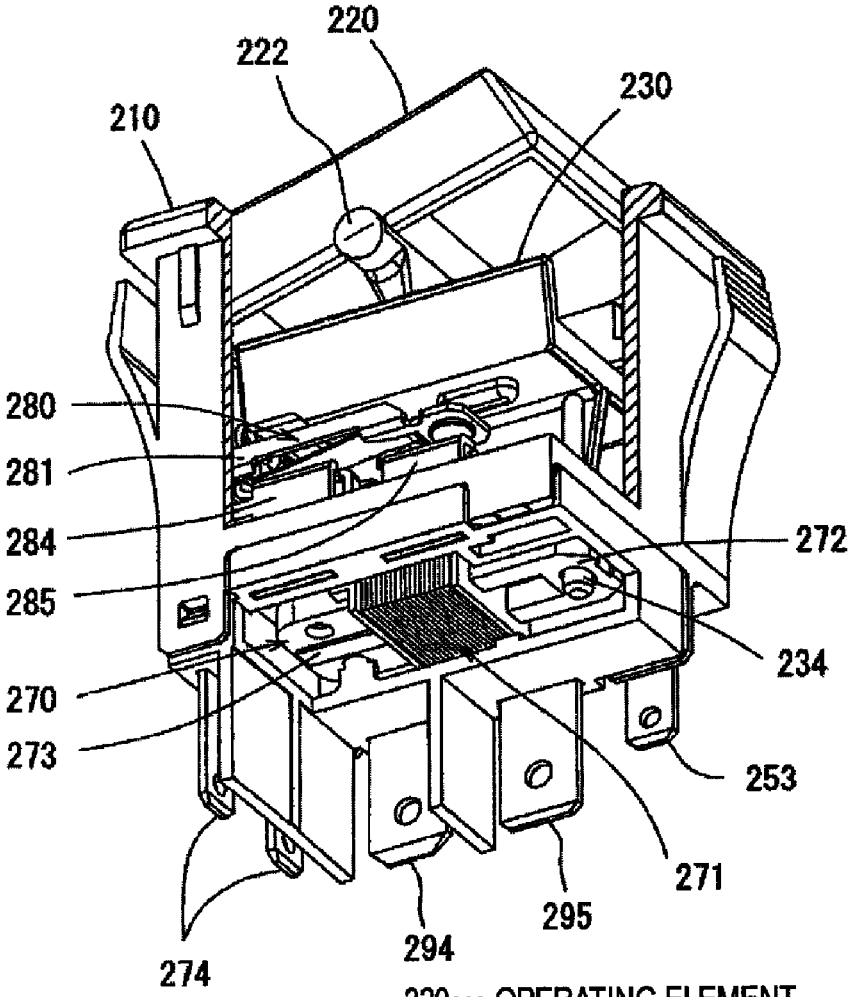
FIG. 14 is a perspective view of the main parts of a solenoid of the second embodiment seen from the diagonally lower side.

As shown in FIG. 14 and FIG. 15A, normally in the first power supply switch mechanism 280, the return spring 260 is extended in the power supply switch OFF state, so that the movable magnetic piece 272 integrated with the slider 230 biased by the return spring 260 is sled in the OFF direction (right side in FIGS. 15A to 15F) to be biased and supported at the OFF position.

In this case, the operating element 220 has the interior operation piece 223 pushed by the pressure receiving portion of the slider 230 so that the operating element 220 is turned to the OFF position. In the OFF state, the power supply OFF state in which the contact 286 of the movable piece 281 is spaced away from the contact 287 of the fixed terminal 283 is obtained because the switch operating portion 233 of the slider 230 is not pushing the movable piece 281 side.

As shown in FIG. 13 and FIG. 15B, in the signal switch mechanism 250, the signal interior operation piece 224 of the operating element 220 pushes the signal movable piece 251 in the contacting direction to come into contact with the signal fixed terminal 253 when the operating element 220 is at the OFF position. In such a signal switch mechanism 250, the conduction state in which the signal movable piece 251 and the signal fixed terminal 253 are brought into contact is set to OFF and the separated state is set to ON.

When the switch 200 configured as above is ON operated, the interior operation piece 223 of the operating element 220 pushes the pressure receiving portion 231 of the slider 230 in the anti-biasing direction against the biasing force of the return spring 260, as shown in FIG. 15C. Furthermore, the return spring regulating shaft 234 pushes the movable magnetic piece 272 in the sliding direction against the biasing force of the return spring 260. The movable magnetic piece 272 thus slides in the ON direction to be inserted into the coil of the solenoid 271, and is adsorbed upon receiving the magnetic attraction action of the permanent magnet 273 opposing on the lower side. In this case, the return spring 260 is in the compressed state, and thus receives the adsorption action in the compressed state and held in such a state. The switch operating portion 233 pushes the receiver fitting 283 downward, so that the movable piece 281 is inverted on the basis thereof thereby bringing the contacts 286, 287 into contact and turning ON the power supply.

The second power supply switch mechanism 290 is ON operated in synchronization with the movement of the first power supply switch mechanism 280.

The signal switch mechanism 250 is turned ON at substantially the same time as the first power supply switch mechanism 280 and the second power supply switch mechanism 290. As shown in FIG. 15D, the signal switch mechanism 250 has the signal movable piece 251 inverted with the turning of the operating element 220 in the ON direction thereby separating the signal movable piece 251 from the signal fixed terminal 253 and turning ON the signal switch mechanism 250.

As shown in FIG. 15E, the operating element 220 is push operated in the OFF direction when turning OFF the switch 200. In this case, the operating element 220 is turned in the OFF direction, but only the operating element 220 is turned, that is, spun around because the biasing force of the return spring 260 is not received on the second power supply switch mechanism 280 side.

Therefore, the slider 230 does not slide, the return spring regulating shaft 234 integrated with the slider 230 maintains a state of holding the movable magnetic piece 272, and the power supply switch mechanism 240 is held in the ON state until a reset signal is inputted from the control unit of the electronic device.

As shown in FIG. 15F, the signal movable piece 251 is inverted with the supporting point as the reference to again come into contact with the signal fixed terminal 253 with the turning of the operating element 220 in the OFF direction on the signal switch mechanism 250 side. The signal switch mechanism 250 is then ON/OFF operated with the movement of the operating element 220.

When the signal switch mechanism 250 is turned OFF, the reset signal from the control unit receiving the OFF signal is waited. The first power supply switch mechanism 180 shown in FIG. 15E again returns from the ON state to the original power supply OFF state shown in FIG. 15A at the time point the storage process of the control data to be storage processed by the hard disk is completed.

As described above, the operation force at which the operating element is operated is converted to a linear movement through the slider. The switch mechanism having a compact configuration such as a micro-switch thus can be adopted, and miniaturization can be achieved.

If the slider 230 is arranged on the operating element 220 side in the internal space of the housing, and the power supply switch mechanism 240 and the power supply reset mechanism 270 are arranged in a stacked state on the more inner side than the slider 230, the internal structure of the switch can be configured to be divided in the stacking direction, so that the accommodating capacity in the stacking direction can be increased and the surface area on the operating element side to be exposed to the outside can be reduced.

Therefore, when attaching the switch to the outer surface of the panel, a great number of switches can be efficiently attached while reducing the surface area to be exposed at the panel surface of the switch.

In the case of the second embodiment as well, after the operating element is once OFF operated, the operating element spins around because the biasing force of the return spring is regulated so that the biasing force of the return spring is not applied on the operating element. Thus, even if the operating element is subsequently again ON/OFF operated, such re-ON/OFF operation force spins the turning portion around at the supporting point, and the operation force from the operating element is not transmitted to the contact of the power supply switch mechanism. Therefore, issues may not arise even if the operating element is again ON/OFF operated afterwards after the operating element is first OFF operated.

In the correspondence of the configuration of one or more embodiments of the present invention and the configuration of the one example described above, the state holding member of one or more embodiments of the present invention corresponds to the rotation operating body 130 and the slider 230 of the second embodiment, the return spring regulating portion corresponds to the return spring regulating piece 134 and the return spring regulating shaft 234, the holding unit corresponds to the permanent magnet 173, 273, and the release unit corresponds to the solenoid 171, 271, and is not limited only to the configuration of the above described embodiments.

While the invention has been described with respect to a limited number of embodiments, those skilled in the art, having the benefit of this disclosure, will appreciate that other embodiments can be devised which do not depart from the scope of the invention as disclosed herein. Accordingly, the scope of the invention should be limited only by the attached claims.

What is claimed is:

1. A switch comprising:

an operating element supported by a housing and operated to one side and an other side;

a return spring for biasing the operating element in a direction operated to the other side in which the operating element is OFF operated;

a power supply switch mechanism for turning ON/OFF a power supply when contacts of a movable piece and a fixed terminal facing each other in the housing are brought into contact with or separated from each other; and a state holding member that receives an operation force from the operating element when the operating element is ON operated to one side and that does not receive the operation force from the operating element when the operating element is OFF operated to the other side;

wherein the state holding member comprises:

a switch operating portion for turning ON the power supply switch mechanism in cooperation with the operation of the state holding member to an anti-biasing direction of the return spring upon receiving the operation force when the operating element is ON operated to one side; and a return spring regulating portion for regulating the return spring in the anti-biasing direction with the turning ON of the power supply switch mechanism, wherein the switch further comprises:

a holding unit for holding a regulation state of the return spring regulated by the return spring regulating portion, and for holding an ON state of the power supply switch mechanism; and a release unit for releasing the ON state of the power supply switch mechanism by the holding unit at the time of power supply reset.

2. The switch according to claim 1, wherein the state holding member is turnably attached on an inner side of the operating element, wherein the power supply switch mechanism comprises the movable piece coupled to the state holding member through an elastic body and the fixed terminal arranged facing the movable piece, and wherein the elastic body elastically displaces in an ON direction and an OFF direction cooperation with the turning of the state holding member, and is configured to bring the movable piece into contact with and separate the movable piece from the opposing fixed terminal based on the elastic displacement of the elastic body.

3. The switch according to claim 1, wherein an interior operating piece is formed in the operating element; and wherein the state holding member is configured by a slider that receives the operation force from the operating element when the operating element is ON operated to one side through the interior operation piece and slides, and that does not receive the operation force from the operating element when the operating element is OFF operated to the other side.

4. The switch according to claim 1, further comprising:

a signal switch mechanism comprising a signal movable piece that cooperatively operates with movement when the operating element is operated, wherein the signal switch mechanism is for turning ON/OFF the signal when the contacts of the signal movable piece and a signal fixed terminal are brought into contact with or separated from each other.

5. An electronic device comprising a switch according to claim 1.

6. The switch according to claim 2, further comprising:

a signal switch mechanism comprising a signal movable piece that cooperatively operates with movement when the operating element is operated, wherein the signal switch mechanism is for turning ON/OFF the signal when the contacts of the signal movable piece and a signal fixed tenninal are brought into contact with or separated from each other.

7. The switch according to claim 3, further comprising:

a signal switch mechanism comprising a signal movable piece that cooperatively operates with movement when the operating element is operated, wherein the signal switch mechanism is for turning ON/OFF the signal when the contacts of the signal movable piece and a signal fixed terminal are brought into contact with or separated from each other.

8. An electronic device comprising a switch according to claim 2.

9. An electronic device comprising a switch according to claim 3.

10. An electronic device comprising a switch according to claim 4.

11. An electronic device comprising a switch according to claim 6.

12. An electronic device comprising a switch according to claim 7.

* * * * *